United States Patent [19]

Bodine

[11] Patent Number: 4,702,315

[45] Date of Patent: Oct. 27, 1987

[54] METHOD AND APPARATUS FOR SONICALLY STIMULATING OIL WELLS TO INCREASE THE PRODUCTION THEREOF

[76] Inventor: Albert G. Bodine, 7877 Woodley Ave., Van Nuys, Calif. 91406

[21] Appl. No.: 900,587

[22] Filed: Aug. 26, 1986

[51] Int. Cl.[4] ..... E21B 43/25

[52] U.S. Cl. ..... 166/249; 166/177

[58] Field of Search ..... 166/249, 177, 308, 104, 166/311, 312

[56] References Cited

U.S. PATENT DOCUMENTS

| | | | |
|---|---|---|---|
| 3,520,362 | 7/1970 | Galle | 166/249 |
| 3,743,017 | 7/1973 | Fast et al. | 166/249 |
| 3,754,598 | 8/1973 | Holloway, Jr. | 166/249 |
| 3,842,907 | 10/1974 | Baker et al. | 166/249 |
| 3,850,135 | 11/1974 | Galle | 166/249 X |
| 4,261,425 | 4/1981 | Bodine | 175/55 X |
| 4,271,915 | 6/1981 | Bodine | 175/56 |
| 4,280,557 | 7/1981 | Bodine | 166/249 X |
| 4,469,175 | 9/1984 | Massa | 166/249 |

*Primary Examiner*—George A. Suchfield

*Attorney, Agent, or Firm*—Edward A. Sokolski

[57] ABSTRACT

A screw type "moyno" sonic oscillator which employs an elongated screw shaped rotor rotatably mounted in a double pitched screw shaped stator is lowered down an oil well casing to a region thereof where effluent is being drawn into the well from a surrounding earthen formation. A pressurized stream of liquid such as water is fed down a pipe string connected to the oscillator assembly so as to rotatably drive the oscillator rotor at a frequency such as to generate sonic energy in a quadrature gyratory mode of oscillation. The pressurized liquid fed to the oscillator exits from the bottom end of the oscillator assembly and rapidly fills the space between the well casing and the oscillator thereby forming a hydrostatic head in this region. A good hydrostatic head is thus rapidly built up in the annulus between the well casing and the oscillator assuring good coupling of sonic energy to the liquid annulus. This liquid annulus is vibrationally driven in pressure waves against the formation to effectively increase its permeability and free any blockage therein, thus facilitating the flow of effluent into the well.

5 Claims, 4 Drawing Figures

METHOD AND APPARATUS FOR SONICALLY STIMULATING OIL WELLS TO INCREASE THE PRODUCTION THEREOF

This invention relates to the servicing of oil wells and more particularly to a method and apparatus employing sonic energy to increase the permeability of a well so as to stimulate the flow of the effluent therefrom.

One of the major problems with oil wells is maintaining flow therefrom particularly in situations where the surrounding formation has low permeability. This may be due to the nature of the formation or may be occasioned by plugging which occurs with the passage of time as the fluids and extraneous material therein move towards the well. Such a low permeability condition is generally manifested by the inability of the well to accept artifically introduced liquids which liquids rapidly form a hydrostatic column in the well which develops the pressure for back flow into the formation.

The method and apparatus of the present invention provides means for stimulating the flow of effluent from oil wells where low permeability conditions are encountered whether this be due to the nature of the formation or plugging which may occur in the course of drawing effluent from the well.

This end result is achieved by employing a "moyno" type positive displacement oscillator which employs a screw shaped rotor which is supported for rotation in a screw shaped casing. The oscillator is lowered down into the oil well casing to the region where flow stimulation from the surrounding formation is required. Pressurized fluid is then fed down to the oscillator through a pipe string on which the oscillator is suspended so as to rotatably drive the oscillator rotor at a sonic frequency which may be the order of 100 Hz. The fluid is fed to the oscillator at a high rate such that a liquid annulus is rapidly formed between the oscillator casing and the well casing, this annulus rising to form a high hydrostatic head in the liquid in the region of the oscillator. The eccentric rotational motion of the oscillator rotor sets up a quadrature or gyratory vibrational force in the liquid which causes the liquid to drive against the formation in a strong pressure wave action. The vibrational frequency of the sonic energy is directly controllable from the surface because the positive displacement characteristic of the moyno oscillator makes it directly responsive to fluid volume flow. This sonic energy penetrates the formation and increases the permeability of thereof.

It is important that there be a high hydrostatic head in the liquid column in the region of the oscillator to assure the development in such liquid of high level sonic energy to effectively permeate the formation. Thus, it is important that there be a high flow rate of the liquid driving the oscillator which builds up and maintains a long enough liquid annulus to maintain this high hydrostatic head.

It is therefore an object of this invention to improve the flow of effluent from wells particularly where the formation being mined has low permeability.

It is a further object of this invention to provide a sonic method and apparatus for stimulating the flow of effluent from wells.

Other objects of this invention will become apparent as the description proceeds in connection with the accompanying drawings of which:

Figure 1:
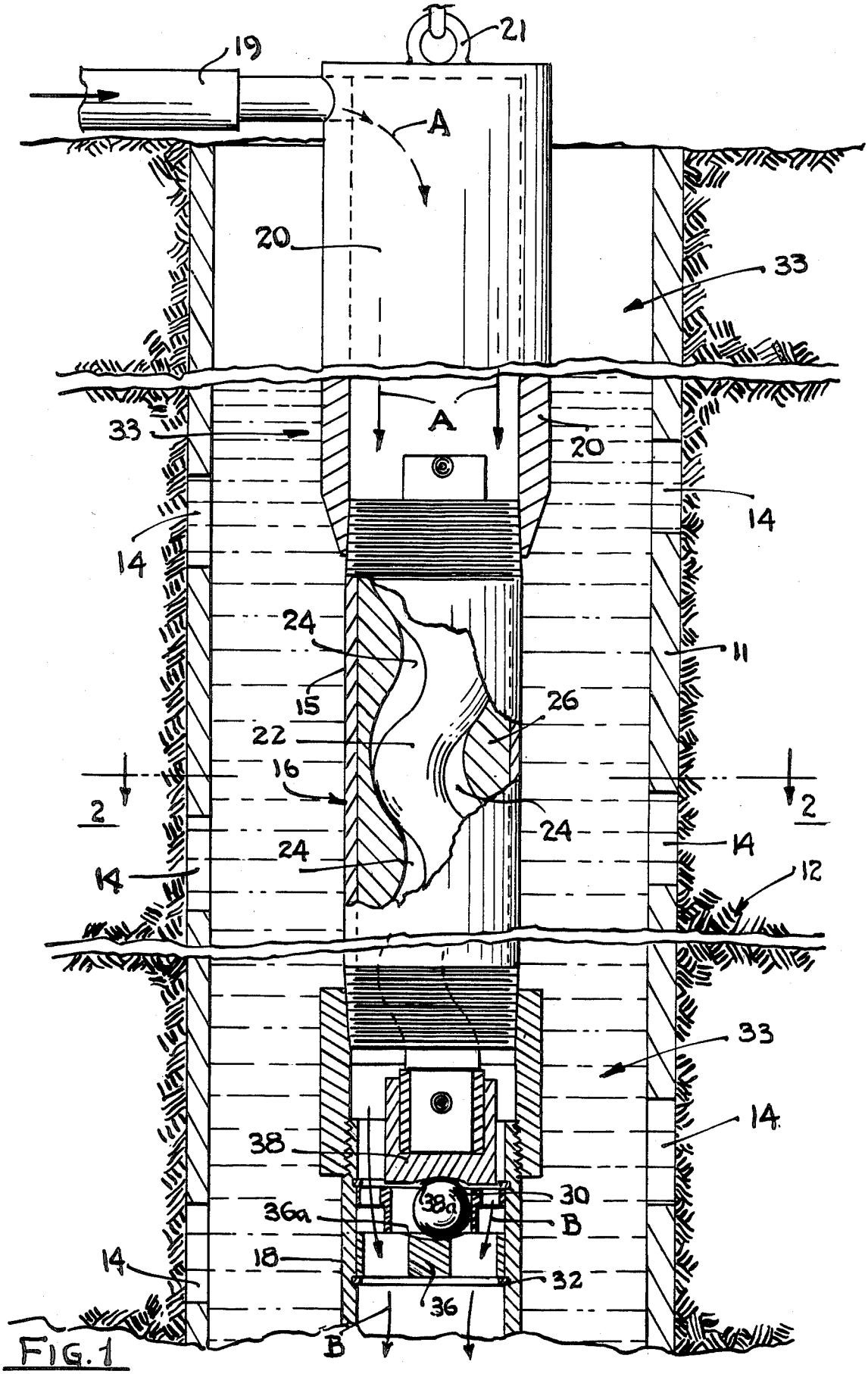
FIG. 1 is an elevational view in cross section of a first embodiment of the invention.
Figure 2:
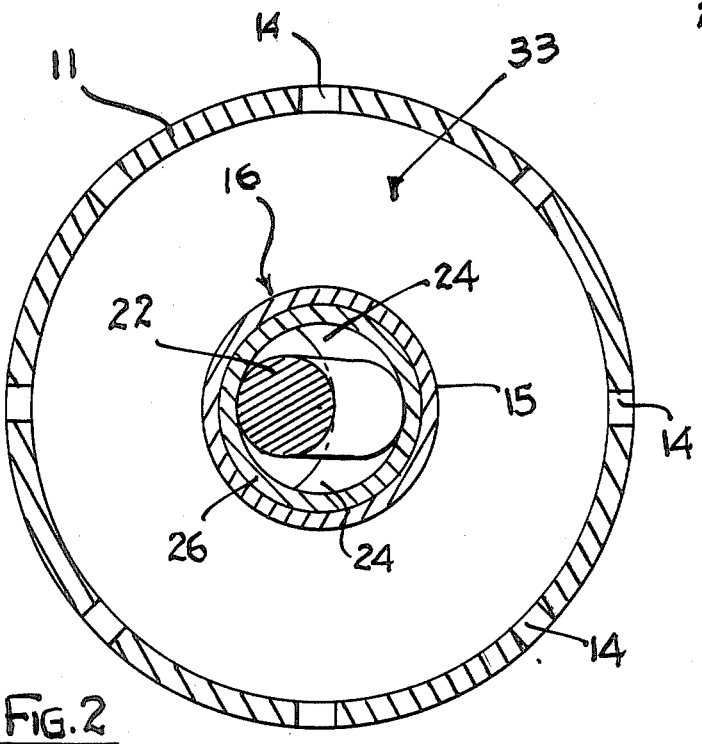
FIG. 2 is a cross sectional view taken along the plane indicated by 2—2 in FIG. 1.
Figure 4:
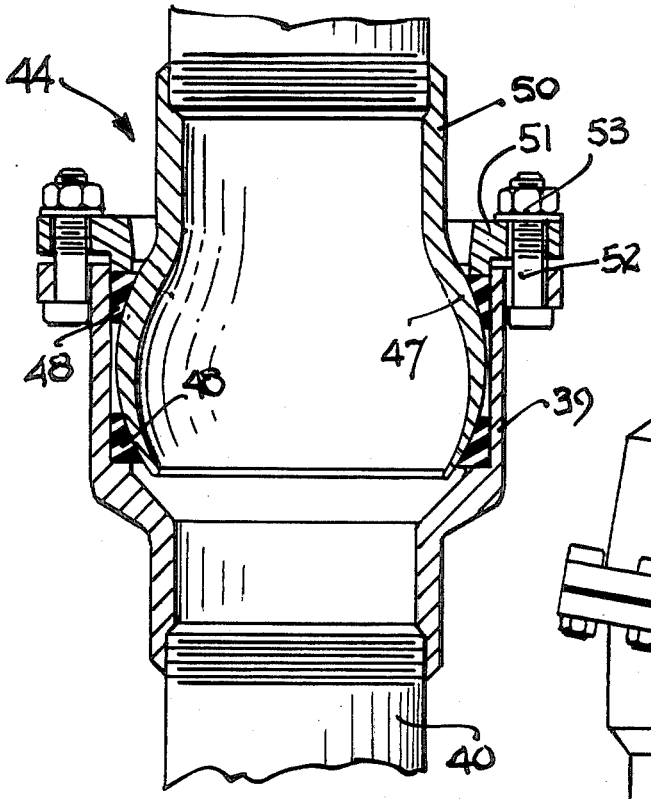
FIG. 4 is an elevational view in cross section of the ball joint structure of the device of FIG. 3.

Referring now to FIGS. 1 and 2 a preferred embodiment of the invention is illustrated. Casing 11 is a well casing installed in earthen formation 12, there being casing perforations 14 formed in the casing to provide fluid communication for effluent (typically oil) being mined from the formation. Oscillator 16 is suspended within casing 11 by means of pipe string 20 which is threadably connected to the housing 15 of the oscillator. Pipe string 20 runs to the surface and is suspended from hook 21 by means of a derrick or the like. The pipe string, as to be explained further on in the specification, not only provides a suspension means for the oscillator but also carries the liquid for driving the oscillator rotor and for establishing a hydrostatic head in the space between the oscillator and the oil well casing. An extension pipe 18 which extends below the oscillator is threadably coupled to the bottom of the oscillator housing 15 to provide additional sonic radiating surface. Oscillator 16 is of the "moyno" type such as described in connection with FIG. 1*a* of my U.S. Pat. No. 4,271,915 and FIG. 2 of my U.S. Pat. No. 4,261,425. This oscillator has a screw shaped rotor 22 which is mounted for rotation in double pitched internal screw shaped stator 26. Cavities 24 are formed between the single pitched rotor and double pitched stator. The bottom end of rotor 22 has an end cap 38 attached thereto which is supported for rotation on ball member 30. The ball member 30 is free to roll between dished surface **38*a* formed on the rotor end cap and dished surface 36*a* formed on spider plate 36 which is fixedly mounted on extension pipe 18 by means of snap rings 32**.

A liquid which may be water is fed in a high volume flow as indicated by arrows A from inlet 19 into pipe string 20 and from the pipe string 20 into the cavities 24 of the oscillator. This liquid stream rotatably drives rotor 22 with the liquid progressing down the cavities 24 and finally exiting from the bottom of the oscillator as indicated by arrows B. Rotor 22 rolls and precesses around in stator 26 and in so doing generates vibrational energy in a quadrature or gyratory mode of vibration. The downward thrusts of the rotor is supported on the thrust bearing formed by ball 30 and the two dished surfaces 36a and 38a in which the ball rotatably rides. The quadrature vibrational energy generated by the oscillator is transferred from the outer surface of oscillator housing 15 to liquid annulus 33 which is formed between the oscillator and the well casing by the liquid used to drive the oscillator rotor. This vibrational gyratory energy is in turn transferred from the liquid annulus 33 to the surrounding formation 12 to effectively permeate the formation and increase its ability to emit effluent to the well. A strong flow of fluid of the order of 100 gallons per minute or more is required to build up a high pressure hydrostatic head in the annulus 33 to achieve optimum transfer of energy through the liquid annulus to the formation. It is also necessary that this flow rate be established to rotate rotor 22 at a speed such as to produce a sonic vibrational output which is tyically of the order of 100 Hz.

It is to be noted that the hydrostatic head will readily build up in view of the low permeability of the surrounding formation which initially permits little of the liquid to flow therethrough. However, after the system has been operated for a time, the hydrostatic head will drop as permeability is inreased and with sufficient lowering of this head, the operation can be terminated. If desired, however, to continue the sonic treatment, additional fluid can be fed directly to the well to re-establish the hydrostatic head while the sonic oscillator is driven in the manner described above.

With the positive displacement moyno oscillator an increase in its fluid feed flow will increase the sonic frequency and thus the sonic energy output. This increases the sonic pressure swings in the fluid annulus because the liquid has high acoustic impedance. These larger pressure swings require greater mean pressure, and in this system such need is provided by the flow increase in annular head.

Figure 3:
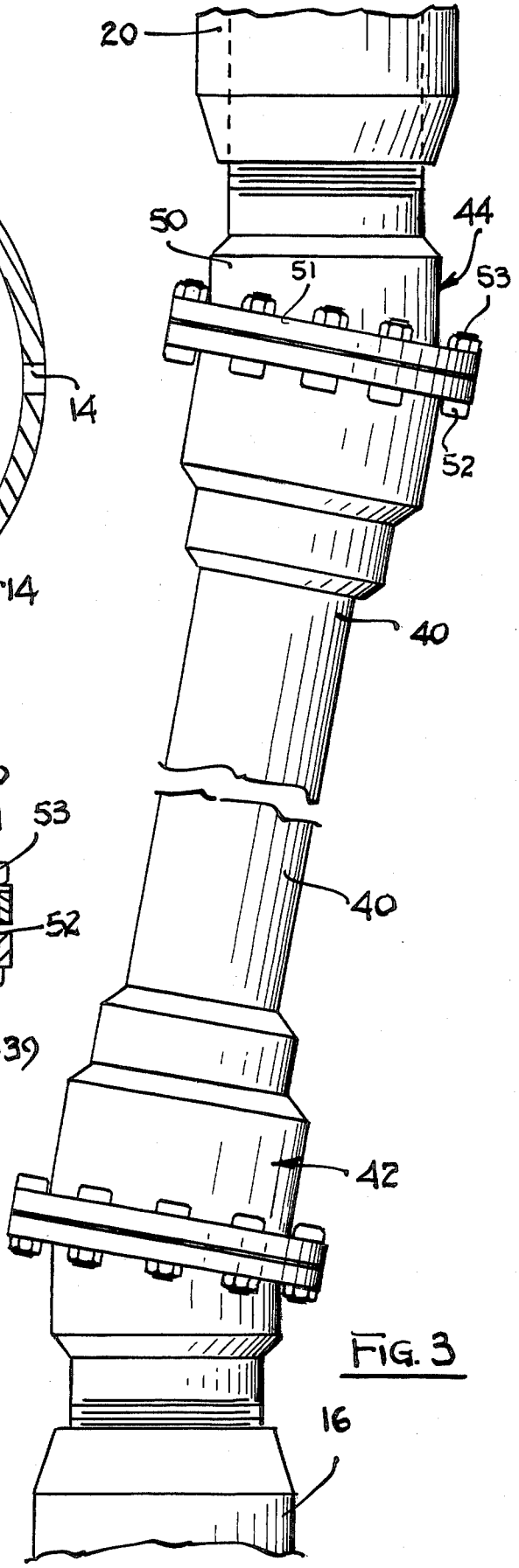
FIG. 3 is an elevational view illustrating a flexible ball joint which may be utilized with the preferred embodiment to reduce the transmission of vibratory energy to the pipe string from which the oscillator is suspended.

Referring now to FIG. 3, a modified version of the device of the invention is illustrated for use in reducing the unwanted transmission of vibratory energy from oscillator 16 to pipe string 20. This end result is achieved by placing a short pipe element 40 having swing ball universal joints 42 and 44 on the opposte ends thereof, these swing ball joints being coupled to oscillator 16 and pipe string 20 respectively. This type of flexible ball joint is commercially available and as shown in the drawing includes a ball shaped member 47 which fits into spherical sockets 48 formed in the opposite ends of pipe section 40. Ball shaped member 47 is formed at the end of a coupler 50 and is joined to housing 39 by means of flange 51 and bolts 52 and nuts 53. Housing 39 is threadably attached to pipe section 40. Thus a universal joint is formed between ball member 47 and the associated sockets 48 in which it rides. This double ball joint system conducts fluid therethrough and gives full freedom of lateral vibration for oscillator 16 thus minimizing the dissipation of such energy in pipe string 20.

While the invention has been described and illustrated in detail, it is to be clearly understood that this is intended by way of illustration and example only and is not to be taken by way of limitation, the spirit and scope of the invention being limited only by the terms of the following claims.

I claim:

1. A method for stimulating the flow of effluent from a formation surrounding a well casing having perforations formed therein for passing the effluent into the casing comprising the steps of:

lowering a positive displacement moyno sonic oscillator into the well casing to the region of said formation so it is suspended freely therein, feeding a stream of liquid down said well casing to said oscillator so as to rotatably drive said oscillator to effect the radiation of gyratory quadrature sonic vibrational energy therefrom, discharging the liquid from said oscillator into said well casing such that such liquid builds up in said well casing a substantial distance above said oscillator and establishes a liquid annulus around the oscillator forming a substantial hydrostatic head in the region of said oscillator, adjusting the rate at which said stream of fluid is fed to said oscillator to bring the vibrational output of said oscillator to a predetermined frequency and to establish and maintain said substantial hydrostatic head in the region of said oscillator thereby to effect the transfer of high level sonic energy from said oscillator through said liquid to said formation, and continuing to feed said liquid to said oscillator until the formation is permeated as indicated by a substantial lowering of the level of said hydrostatic head.

2. The method of claim 1 and including the additional step of feeding a second stream of liquid into said well when the level of the hydrostatic head lowers so as to raise said level, and continuing to drive said oscillator with the first mentioned stream of liquid for a predesired period of time.

3. The method of claim 1 wherein said oscillator is connected to a pipe string and lowered into the well by being suspended on said pipe string, the stream of liquid being fed to said oscillator through said pipe string.

4. A system for stimulating the flow of effluent from a formation surrounding a well casing having perforations formed therein for passing the effluent from the formation into the casing comprising:

a moyno positive displacement oscillator, pipe string means attached to said oscillator for suspending said oscillator within said well casing in the region of said perforations and said formation, and means for feeding a stream of liquid through said pipe string to said oscillator at a predetermined rate to drive said oscillator to effect the generation thereby of gyratory quadrature sonic vibrational energy, the liquid stream passing through said oscillator into the well casing and forming a body of liquid in the space between the oscillator and the well casing, said liquid body rising in said casing above the oscillator to establish a liquid annulus around the oscillator forming a substantial hydrostatic head in the region of the oscillator, whereby sonic energy is coupled from said oscillator through the body of liquid to the formation to cause the permeation thereof thereby enhancing the flow of effluent therefrom.

5. The system of claim 4 and further including flexible pipe joint means interposed between the oscillator and the pipe string means for providing vibrational isolation between the pipe string means and the oscillator.

* * * * *